US010034110B2

(12) United States Patent
Shi et al.

(10) Patent No.: US 10,034,110 B2
(45) Date of Patent: Jul. 24, 2018

(54) LOUDSPEAKER TO GENERATE SUSTAINABLE HIGH QUALITY AUDITORY IMPRESSION

(71) Applicants: Shengrong Shi, Shenzhen (CN); Fuhu Zhang, Shenzhen (CN); Ronglin Linghu, Shenzhen (CN)

(72) Inventors: Shengrong Shi, Shenzhen (CN); Fuhu Zhang, Shenzhen (CN); Ronglin Linghu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/415,903

(22) Filed: Jan. 26, 2017

(65) Prior Publication Data

US 2018/0020303 A1 Jan. 18, 2018

(30) Foreign Application Priority Data

Jul. 18, 2016 (CN) ..... 2016 2 0754874 U

(51) Int. Cl.

| | |
|---|---|
| ***H04R 29/00*** | (2006.01) |
| ***H04R 9/04*** | (2006.01) |
| ***H04R 9/06*** | (2006.01) |

(52) U.S. Cl.

CPC ..... *H04R 29/003* (2013.01); *H04R 9/046* (2013.01); *H04R 9/06* (2013.01); *H04R 2400/11* (2013.01)

(58) Field of Classification Search

CPC .... H04R 29/001; H04R 1/403; H04R 29/003; H04R 1/323; H04R 1/345

See application file for complete search history.

(56) References Cited

U.S. PATENT DOCUMENTS

| | | | | |
|---|---|---|---|---|
| 2003/0174849 | A1* | 9/2003 | Saiki | H04R 1/2834 381/89 |
| 2010/0316247 | A1* | 12/2010 | Ding | G08B 7/066 381/397 |
| 2016/0286318 | A1* | 9/2016 | Yuasa | F21V 33/0056 |
| 2016/0345114 | A1* | 11/2016 | Hanna | H04R 29/001 |

* cited by examiner

*Primary Examiner* — Mohammad Islam

(74) *Attorney, Agent, or Firm* — Na Xu; IPro, PLLC

(57) ABSTRACT

A loudspeaker is disclosed. The loudspeaker includes a frame; a vibration system accommodated in the frame and comprising a vibrating diaphragm and a voice coil for driving the vibrating diaphragm fixed with the frame; a magnetic circuit system driving the vibration system; a light source assembled with the voice coil; a photosensitive sensor located in the yoke and within the irradiation scope of the light source. The magnetic circuit system includes a yoke positioned by the frame and a magnet portion supported by the yoke.

5 Claims, 3 Drawing Sheets

LOUDSPEAKER TO GENERATE SUSTAINABLE HIGH QUALITY AUDITORY IMPRESSION

FIELD OF THE INVENTION

The present disclosure relates to the field of electroacoustic transducer, more particularly to a loudspeaker.

DESCRIPTION OF RELATED ART

As a kind of sound generator used for the electric equipment including the mobile phones and tablets etc., the loudspeaker has been applied in the people's daily lives extensively.

In the relevant technologies, a loudspeaker comprises a vibration system and a magnetic circuit system driving the vibration system to vibrate. The vibration system comprises a vibrating diaphragm and a voice coil driving the vibrating diaphragm. During the vibration of the vibrating diaphragm, when an amplitude is too much, it is easy to drive the other parts in the vibrating system to collide with the fixed parts in the loudspeaker, which will make the sound signal distorted, and the loudspeaker can't guarantee its high quality auditory impression and sound quality sustainably, and it is difficult to guarantee the reliability yield of a product.

Thereof, it is necessary to disclose a loudspeaker thereof.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of the present disclosure more apparent, the present disclosure is described in further detail together with the figures and the embodiment. It should be understood the specific embodiment described hereby are only to explain this disclosure, not intended to limit this disclosure.

Figure 1:
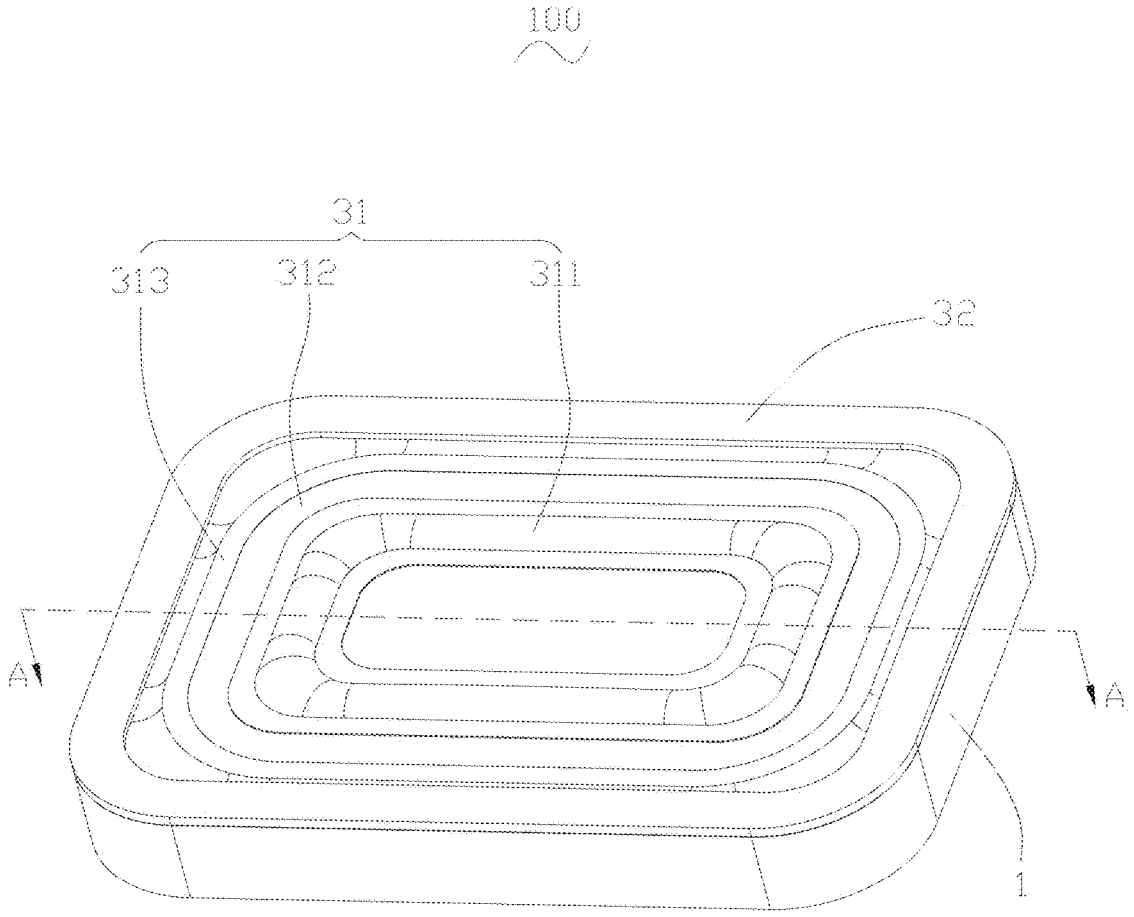
FIG. 1 is an isometric view of a loudspeaker with an exemplary embodiment of the present disclosure.
Figure 2:
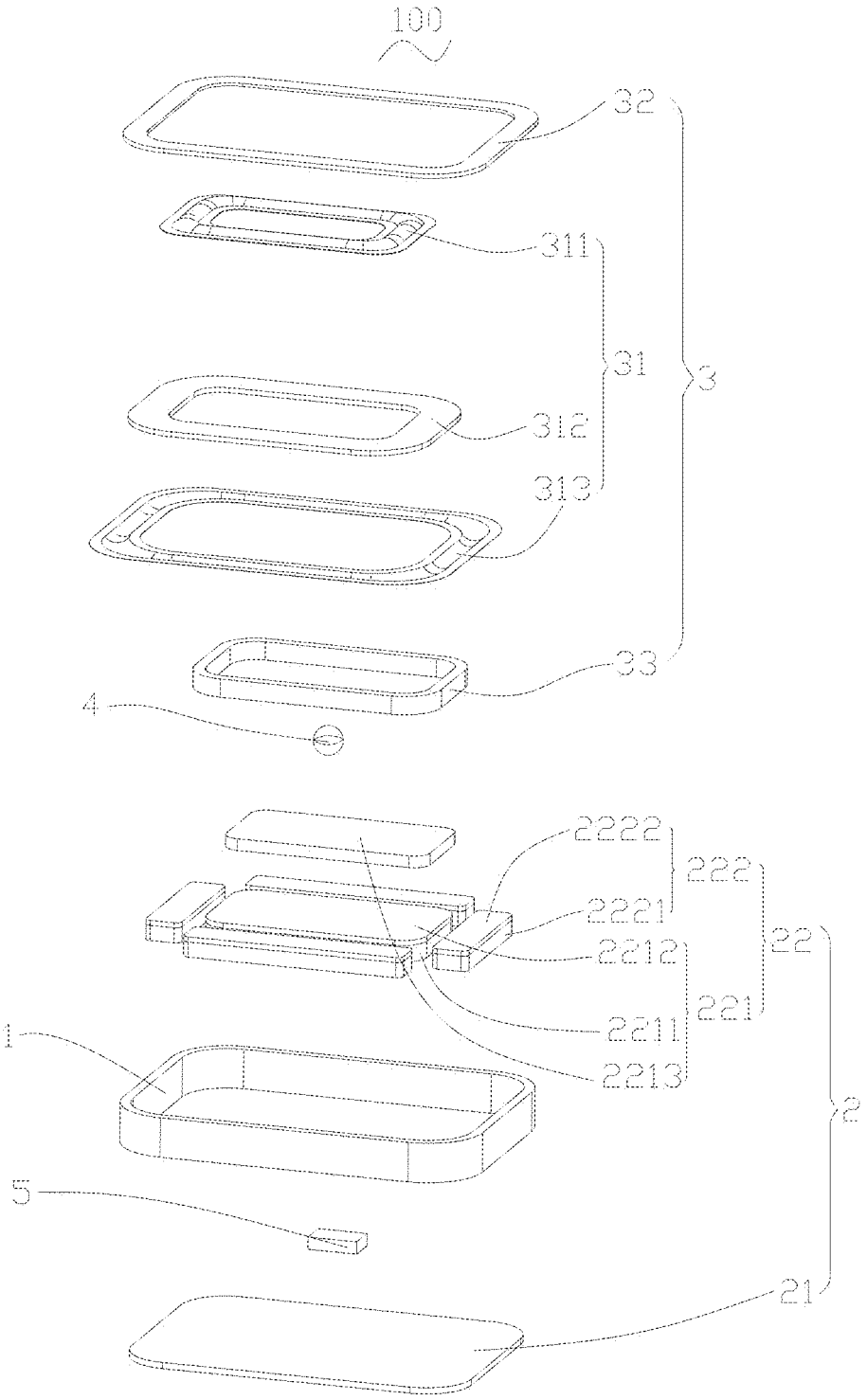
FIG. 2 is an exploded view of the loudspeaker in FIG. 1.
Figure 3:
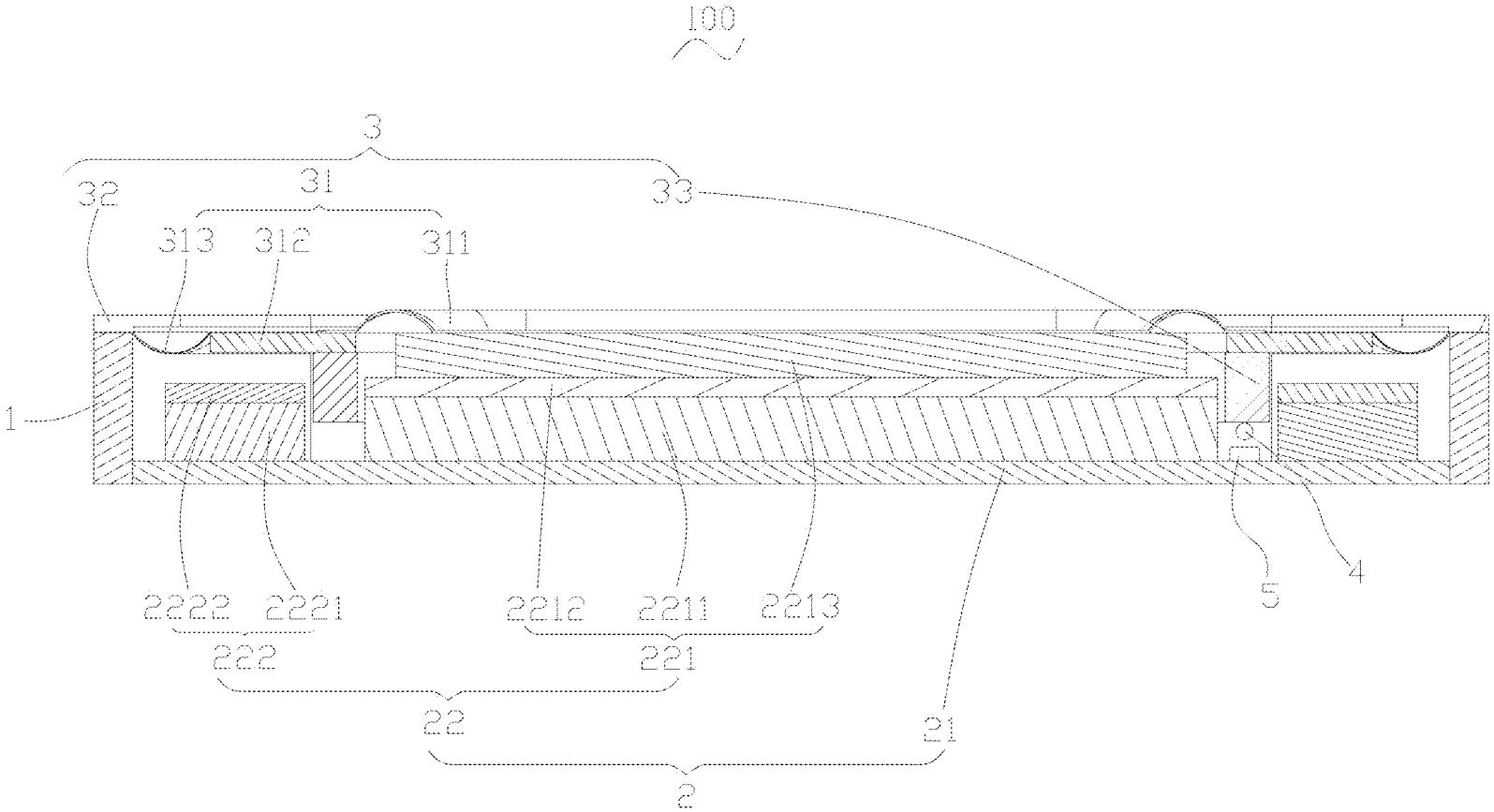
FIG. 3 is a cross-sectional view of the loudspeaker taken along line A-A in FIG. 1.

Referring to FIGS. 1-3, a loudspeaker 100 in accordance with an exemplary embodiment of the present disclosure comprises a frame 1, a magnetic circuit system 2, a vibrating system 3, a light source 4 and a photosensitive sensor 5. The frame 1 has an accommodation space, and the magnetic circuit system 2, the vibrating system 3, the light source 4 and the photosensitive sensor 5 are accordingly accommodated in the accommodation space.

The magnetic circuit system 2 comprises a yoke 21 fixed to the frame 1 and a magnet portion 22 mounted to the yoke 21. The yoke 21 is a flat plate, which can be fixed under the bottom of the frame 1 specifically. The yoke 21 includes an installation slot for installing the photosensitive sensor 5.

The magnet portion 22 comprises a first magnet portion 221 and a second magnet portion 222, and the second magnet portion 222 is located around the first magnet portion 221 for forming a magnet gap 223 with the first magnet portion 221.

Specifically, the first magnet portion 221 comprises a first main magnet 2211, a main pole plate 2212 attached to a top of the main magnet 2211, and a second main magnet 2213 attached to the main pole plate 2212 such that the main pole plate 2212 is sandwiched between the first main magnet 2211 and the second main magnet 2213.

The second magnet portion 222 comprises an auxiliary magnet 2221 and an auxiliary pole plate 2222 overlapped on the auxiliary magnet 2221. Four auxiliary magnets 2222 locate at and keep a distance from four sides of the main magnet 2211 respectively. Four auxiliary pole plates 2222 are provided corresponding to the auxiliary magnets 2221. The four auxiliary magnets 2221 locate around four sides of the main magnet 2211, and the magnetic gap 223 is formed by the gap between the main magnet 2211 and the auxiliary magnet 2222.

The vibrating system 3 comprises a vibrating diaphragm 31, a gasket 32 and a voice coil 33 for driving the vibrating diaphragm 31.

The diaphragm 31 comprises a first suspension 311, a dome 312 and a second suspension 313. The first suspension 311 is located in a middle of the diaphragm 31, and the second suspension 313 connects to an edge of the vibrating diaphragm 31, and the dome 312 connects the first suspension 311 to the second suspension 313. An inner periphery side of the first suspension 311 is fixed to the first magnet portion 221, and one end of the second suspension 313 away from the dome 312 is connected to the frame 1. Specifically, the second suspension 313 connects one side of the frame 1 opposite to the yoke 21.

The gasket 32 is attached to a side of the frame 1 opposite to the yoke 21 for fixing the vibrating diaphragm 31 onto the frame 1. The vibrating diaphragm 31 is clamped between the gasket 32 and the frame 1. The gasket 32 has a shape of a ring, part of which is overlapped with the second suspension 313, and the other part is suspended above the second suspension 313.

One end of the voice coil 33 is connected to the dome 312, and the other end is connected to the light source 4, and the voice coil 33 is at least partially inserted into the magnetic gap 223 together with the light source 4.

Both the light source 4 and the photosensitive sensor 5 are connected to an external circuit. The light source 4 detects the amplitude of the vibrating diaphragm 31 for outputting a light signal, and the photosensitive sensor 5 receives the light signal from the light source 4 for sensing an illumination of the light source 4 and converts the light signal into an electric signal. The light source 4 is assembled with the voice coil 33, and the photosensitive sensor 5 is assembled with the yoke 21, in order to make the photosensitive sensor 5 in the irradiation scope of the light source 4.

Optionally, the light source 4 is set at one end of the voice coil 33 opposite to the yoke 21, and the light source 4 and the photosensitive sensor 5 are opposite to each other, i.e. the photosensitive sensor 5 is set opposite to the magnetic gap 223 of the yoke 21, in order to make the photosensitive sensor 5 receive a stronger light signal, and benefit improving the accuracy of the testing result.

The photosensitive sensor 5 is a kind of photodiode, phototransistor, photoresistor or photomultiplier, which can obtain the amplitude of the vibrating diaphragm 31 by a current signal collected accurately.

When working, the light source 4 outputs the amplitude of the vibrating diaphragm 31, and the photosensitive sensor 5 receives the light signal from the light source 4, and converts an amplitude change of a vibrating diaphragm 31 into a change of an electric signal, and outputs the change data of the electric signal to an external circuit, and the external circuit obtains an amplitude signal of the vibrating diaphragm 31 by detecting a current signal output by the photosensitive sensor 5, so as to adjust an input signal of the loudspeaker 100, and make its amplitude of the vibrating diaphragm 31 in the extreme scope where any collision doesn't occur constantly, in order to guarantee its auditory impression and sound quality of the loudspeaker sustainably.

Comparing with relevant technologies, the beneficial results of the loudspeaker provided by this disclosure as follows: by adding a light source 4 and a photosensitive sensor 5 connected to an external circuit, the photosensitive sensor 5 converts an amplitude change of a vibrating diaphragm 31 into a change of an electric signal, and outputs the change data of the electric signal to an external circuit, and the external circuit obtains an amplitude signal of the vibrating diaphragm by testing a current signal output by the photosensitive sensor 5, so as to adjust an input signal of the loudspeaker, and make its amplitude of the vibrating diaphragm 31 in the extreme scope where any collision doesn't occur constantly, in order to guarantee its 100 auditory impression and sound quality of the loudspeaker sustainably.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A loudspeaker comprising:

a frame;

a vibration system accommodated in the frame and comprising a vibrating diaphragm and a voice coil for driving the vibrating diaphragm fixed with the frame;

a magnetic circuit system driving the vibration system, the magnetic circuit system comprising a yoke positioned by the frame and a magnet portion supported by the yoke;

a light source assembled with the voice coil;

a photosensitive sensor located in the yoke and within the irradiation scope of the light source;

wherein the light source is set at one end of the voice coil opposite to the yoke, and the light source and the photosensitive sensor are opposite to each other; and the magnet portion comprises a first magnet portion and a second magnet portion, and the second magnet portion locates around the first magnet portion and forms a magnetic gap with the first magnet portion, and the voice coil is inserted into the gap together with the light source.

2. The loudspeaker as described in claim 1, wherein the photosensitive sensor is a photodiode, a phototransistor, a photoresistor or a photomultiplier.

3. The loudspeaker as described in claim 1, wherein the photosensitive sensor is opposite to the magnet gap.

4. The loudspeaker as described in claim 3 wherein an installation slot is formed in the yoke, and the photosensitive sensor is installed in the installation slot.

5. The loudspeaker as described in claim 3, wherein the vibrating diaphragm comprises a first suspension in a middle thereof, a second suspension and a dome located between the first suspension and the second suspension, and an inner periphery side of the first suspension is fixed to the first magnet portion, and one end of the voice coil away from the yoke is connected to the dome.

* * * * *